US009435332B2

(12) United States Patent
Ishii et al.

(10) Patent No.: US 9,435,332 B2
(45) Date of Patent: Sep. 6, 2016

(54) ELECTROMAGNETIC VIBRATING DIAPHRAGM PUMP WITH FUNCTION PREVENTING FLUID LEAKAGE TO ELECTROMAGNETIC PORTION

(75) Inventors: Hideki Ishii, Osaka (JP); Tsuyoshi Takamichi, Osaka (JP)

(73) Assignee: TECHNO TAKATSUKI CO., LTD., Osaka (JP)

( * ) Notice: Subject to any disclaimer, the term of this patent is extended or adjusted under 35 U.S.C. 154(b) by 336 days.

(21) Appl. No.: 14/006,274

(22) PCT Filed: Mar. 29, 2012

(86) PCT No.: PCT/JP2012/058310

§ 371 (c)(1),
(2), (4) Date: Oct. 4, 2013

(87) PCT Pub. No.: WO2012/137658

PCT Pub. Date: Oct. 11, 2012

(65) Prior Publication Data

US 2014/0023531 A1 Jan. 23, 2014

(30) Foreign Application Priority Data

Apr. 8, 2011 (JP) ..... 2011-086681

(51) Int. Cl.
*F04B 43/04* (2006.01)
*F04B 45/04* (2006.01)
*F04B 43/00* (2006.01)

(52) U.S. Cl.
CPC ..... *F04B 43/04* (2013.01); *F04B 43/009* (2013.01); *F04B 45/043* (2013.01)

(58) Field of Classification Search
CPC .... F04B 43/04; F04B 43/009; F04B 45/043; H02K 5/04; H02K 5/08; H02K 5/10; H02K 33/00–33/18; H02K 5/12–5/1285; H02K 2005/1287
See application file for complete search history.

(56) References Cited

U.S. PATENT DOCUMENTS

2005/0254971 A1* 11/2005 Ohya et al. ..... 417/413.1
2007/0252445 A1* 11/2007 Shinohira et al. ..... 310/12

(Continued)

FOREIGN PATENT DOCUMENTS

JP 2003343446 A 12/2003
JP 2005133587 A 5/2005

OTHER PUBLICATIONS

International Preliminary Report on Patentability, App PCT/JP2012/058310 mailing date Oct. 17, 2013.

(Continued)

*Primary Examiner* — Peter J Bertheaud
*Assistant Examiner* — Dnyanesh Kasture
(74) *Attorney, Agent, or Firm* — Perman & Green, LLP

(57) ABSTRACT

An electromagnetic vibrating diaphragm pump is provided which is safe even when a diaphragm of a diaphragm pump is damaged and liquid or flammable gas penetrates an electromagnetic drive. An electromagnet coil container containing electromagnet coils in an airtight manner is further provided inside a casing, preventing fluid which has penetrated into the space outside the electromagnet coil container from penetrating into the space inside the electromagnet coil container. The electromagnet coil container has a passage formed for an oscillator to move in reciprocation and the passage is formed of a partition wall outside the container. The electromagnetic coil container is configured to prevent fluid which has penetrated into the space inside the passage from penetrating into the space inside the electromagnet coil container.

16 Claims, 5 Drawing Sheets

(56) References Cited

U.S. PATENT DOCUMENTS

2007/0258835 A1* 11/2007 Ichiyanagi et al. ..... 417/413.1
2008/0050251 A1 2/2008 Zabar

OTHER PUBLICATIONS

International Search Report, App PCT/JP2012/058310 dated Jun. 26, 2012.

* cited by examiner

ELECTROMAGNETIC VIBRATING DIAPHRAGM PUMP WITH FUNCTION PREVENTING FLUID LEAKAGE TO ELECTROMAGNETIC PORTION

CROSS-REFERENCE TO RELATED APPLICATIONS

This application is the National Stage of International Application No. PCT/JP2012/058310 International Filing date, 29 Mar. 2012, which designated the United States of America, and which International Application was published under PCT Article 21 (s) as WO Publication 2012/137658 A1 and which claims priority from, and the benefit of, Japanese Application No. 2011-086681 filed 8 Apr. 2011, the disclosures of which are incorporated herein by reference in their entireties.

BACKGROUND

The presently disclosed embodiment relates to an electromagnetic vibrating diaphragm pump with a function preventing fluid leakage to an electromagnetic portion.

As a conventional diaphragm pump for discharging air, an electromagnetic vibrating diaphragm pump disclosed in Patent Document 1 is known. As shown in FIG. 5, the diaphragm pump disclosed in Patent Document 1 comprises a drive 14 adapted to drive diaphragms 13 by the vibration of an oscillator 12 provided with permanent magnets 11 caused by magnetic interactions between a pair of magnet coils 10 and the permanent magnets 11 so as to suction gas from outside and discharge the gas outside, wherein due to the action of the drive 14, gas suctioned from a suction port 17 is compressed in a pump casing 16 and then discharged from an exhaust port 15. The drive 14 has the pair of magnet coils 10 provided in a way to sandwich the oscillator 12 and drives the oscillator 12 by applying alternating-current voltage to the magnet coils 10 in order to provide pump action. This diaphragm pump can in principle suction and discharge fluid such as water, gaseous body such as gas, including the air in the atmosphere above all. Additional background information may be found in Japanese publication JP 2003-343446 A.

SUMMARY

As described above, the diaphragm pump disclosed in Patent Document 1 has electromagnet coils 10 housed in a casing, enabling the prevention of penetration of water, etc., from outside. However, for example, when suctioning and discharging liquid such as water or flammable gas, penetration by the liquid or flammable gas into the electromagnetic drive 14 due to deteriorated and damaged diaphragm 13 results in risk of short circuit or explosion upon contacting a live part where the terminals of the electromagnet coils 10 are provided.

Accordingly, in the light of the problem, an object of the presently disclosed embodiment is to provide a safe electromagnetic vibrating diaphragm pump which prevents the penetration by liquid or flammable gas into the electromagnetic drive even when the diaphragm of the diaphragm pump is damaged.

The electromagnetic vibrating diaphragm pump of the presently disclosed embodiment comprising a casing containing a pair of opposing electromagnet coils to which an alternating-current power source is connected and an oscillator arranged movably in reciprocation between the pair of electromagnet coils, and a pair of pump casings fixed to both ends of the casing via diaphragms fixed to both ends of the oscillator, and adapted to suction fluid from outside and discharge fluid to outside by the reciprocating motion of the oscillator and the elastic deformation of the diaphragms, wherein an electromagnet coil container containing the electromagnet coils in an airtight manner is further provided inside the casing, the electromagnet coil container is configured to prevent fluid penetrated into a space outside the electromagnet coil container from penetrating into a space inside the electromagnet coil container, and wherein the electromagnet coil container has a passage formed for the oscillator to move in reciprocation and the passage is formed of an outer surface of a partition wall of the electromagnet coil container, preventing fluid penetrated into a space inside the passage from penetrating into a space inside the electromagnet coil container.

In addition, it is preferred that the partition wall of the container is made of material of magnetic permeability and non-magnetic body.

In addition, it is preferred that the electromagnetic vibrating diaphragm pump is for liquid or flammable fluid.

In addition, it is preferred that the passage is formed along the moving direction of the oscillator, and that the cross-sectional shape of the container perpendicular to the moving direction of the oscillator is substantially O-shaped or substantially U-shaped.

In addition, it is preferred that the container is formed in integration with the casing.

According to the presently disclosed embodiment, since inside the casing, the electromagnet coils are further contained in the electromagnet coil container in an airtight manner, liquid or flammable fluid never contacts the live part of electromagnet coil such as terminals of electromagnetic coil even if liquid or flammable fluid has flown into the casing due to damaged diaphragm, damaged casing and so on. Therefore, risk of short circuit and explosion can be reduced, allowing the provision of a safe electromagnetic vibrating diaphragm pump. Also, even an electromagnetic vibrating diaphragm pump with a structure to send the fluid, that is to be suctioned and discharged, through inside the casing into the pump casing can be driven safely with reduced risk of short circuit and explosion. Therefore, the presently disclosed embodiment can provide an electromagnetic vibrating diaphragm pump for liquid and flammable.

DETAILED DESCRIPTION

Figure 1:
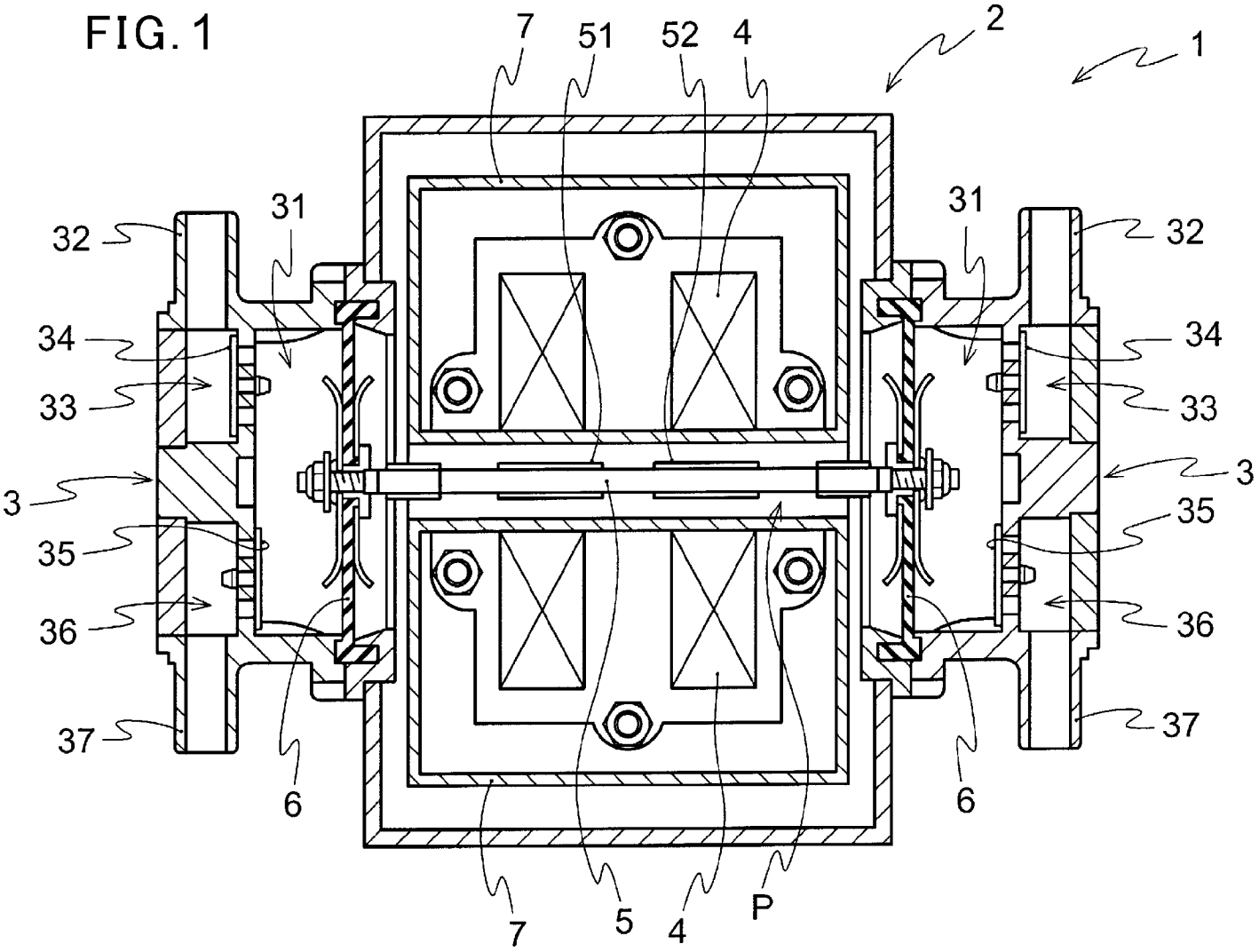
FIG. 1 A cross-sectional view for schematically explaining the electromagnetic vibrating pump of the presently disclosed embodiment.

With reference to the attached drawings, the electromagnetic vibrating diaphragm pump of the presently disclosed embodiment will be described in details below. As shown in FIG. 1, an electromagnetic vibrating diaphragm pump (hereinafter referred to as a pump, simply) 1 of the presently disclosed embodiment is provided with a casing 2 containing elements to drive the pump 1 inside thereof and a pump casing 3 serving as a flow passage for fluid suctioned and discharged.

A pair of opposing electromagnet coils 4 to which the alternating-current power source (not illustrated) is connected and an oscillator 5 arranged movably in reciprocation between the pair of electromagnet coils 4 are contained inside the casing 2. Alternating-current voltage applied from the alternating-current power source to the electromagnet coils 4 causes the oscillator 5 to move in reciprocation toward the right and left in FIG. 1 because of the magnetic action of the magnet coils 4, 4 and of permanent magnets 51, 52 of the oscillator 5 arranged in the space between the electromagnet coils 4, 4.

Diaphragms 6 are fixed by known fixing means at the both ends of the oscillator 5 moving in reciprocation and the diaphragms 6 as well undergo elastic deformation according to the reciprocal motion of the oscillator 5, increasing and decreasing the pressure of fluid inside a compression chamber 31 of the pump casing 3 so as to suction and discharge the fluid. In FIG. 1, the pump casing 3 is configured in such a way that fluid flows from a suction port 37 through a suction chamber 36 and a suction valve 35 into the compression chamber 31 and the fluid is discharged from the compression chamber 31 through an exhaust valve 34 and an exhaust chamber 33 to an exhaust port 32. However, structure of the pump casing 3 is not limited to the structure shown in FIG. 1, and there is no specific limitation as long as its structure enables inflow and discharge of fluid by the elastic deformation of the diaphragms 6. Therefore, the fluid from outside is not necessarily suctioned from the side of the pump casing 3 but from the side of the casing 2 and the fluid suctioned from the side of the casing 2 can be transferred to the side of the pump casing 3. Alternatively, it can be configured such that fluid discharged through the compression chamber 31 is transferred from the side of the pump casing 3 to the side of the casing 2, and then discharging from the side of the casing 2.

Next, an electromagnet coil container (hereinafter referred to as a container, simply) 7 containing the electromagnet coils 4 of the pump 1 of the presently disclosed embodiment will be described by using FIGS. 1 and 2. As shown in FIG. 1, in the space inside the casing 2, the electromagnet coils 4 are further contained in the container 7 in an airtight manner.

Figure 2:
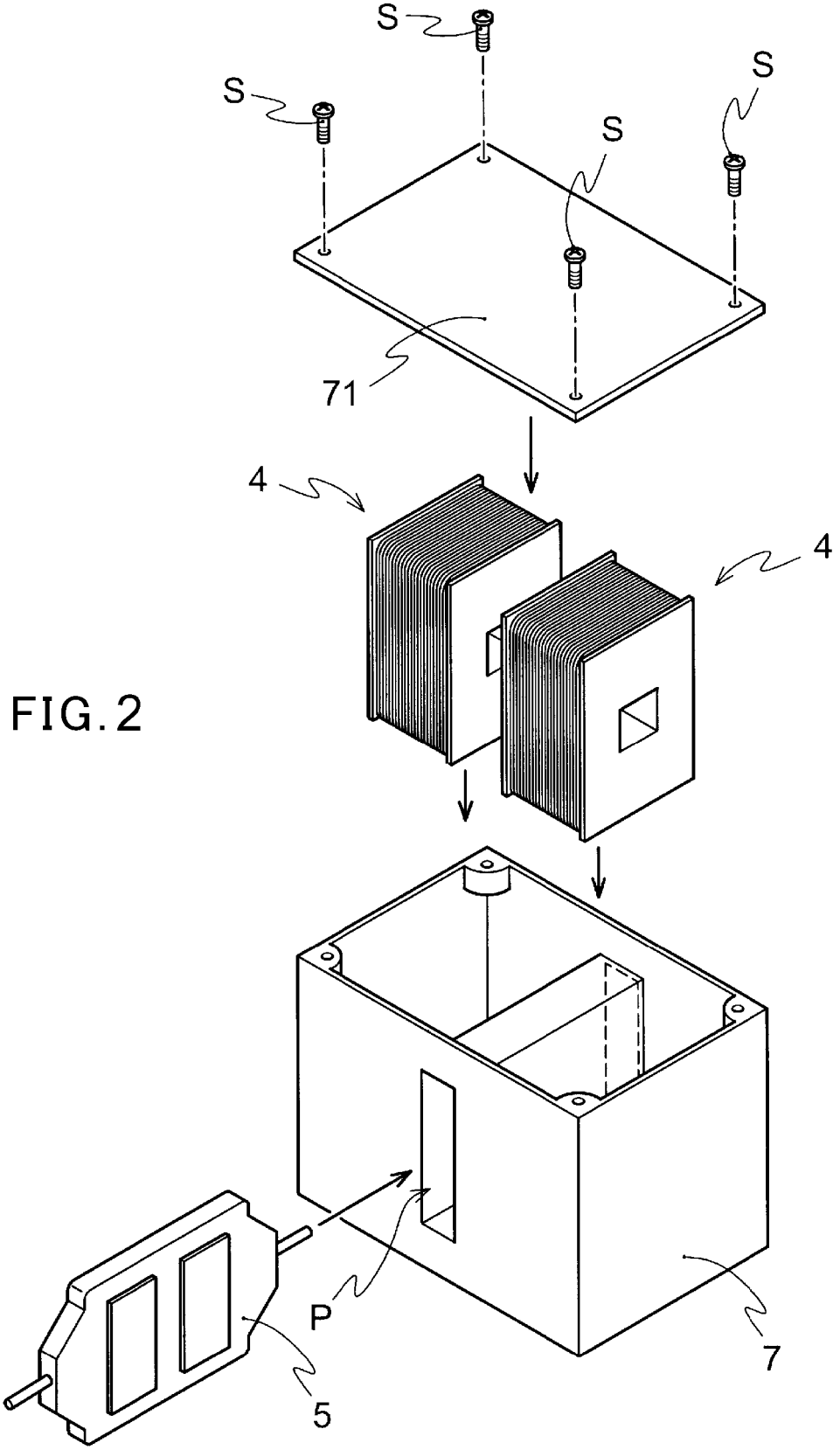
FIG. 2 A perspective view as an erection diagram of one embodiment of the electromagnet coil container used for the electromagnetic vibrating pump of the presently disclosed embodiment.

As shown in FIGS. 1 and 2, the container 7 contains both of the pair of electromagnet coils 4 inside thereof. In one embodiment, the container 7 has a box-like shape with a passage formed for inserting the oscillator 5 along the vibrating direction of the oscillator 5. The pair of electromagnet coils 4 is contained inside the container 7, and the container 7 is sealed by a cover 71 attached on the open upper portion and a fixing means S such as a screw to prevent the electromagnet coils 4 from contacting fluid outside the container 7. Although the container 7 is sealed with the cover 71 and the fixing means S, it is sufficient that the container 7 is configured to prevent the fluid penetrated the space outside the container 7 from penetrating the space inside the container 7. Therefore, the cover 71 may be positioned above, under or on the side of the container 7. The fixing means S is not limited to a screw and the container can be sealed by adhesive and welding, etc.

In addition, although not illustrated, the air-tightness between the cover 71 and the opening of the container 7 can be further improved by a sealing member such as a gasket, and the presently disclosed embodiment includes the structure for sealing with such a sealing member in-between, too. By the way, terminal sections (not illustrated) of the electromagnet coils 4 are contained in the container 7, and air-tightness inside the container 7 for a wiring from the terminal to the power supply of the electromagnet coils 4 is, although not illustrated, is secured by providing a bushing on the cover 71, for example.

In addition, in the container 7, the oscillator passage (hereinafter referred to as a passage, simply) P for ensuring the reciprocating motion of the oscillator 5 is formed. As shown in FIGS. 1 and 2, the passage P is defined by the partition wall outside the container 7. Therefore, the space inside the passage P is not linked with the space inside the container 7 and it is configured to prevent fluid penetrated inside the passage P from penetrating the space inside the container 7.

Since the space inside the container 7 is divided from the space outside the container 7 in this way, even if the fluid suctioned and discharged is liquid or flammable gas and the liquid or flammable gas penetrates inside the casing 2 due to, for example, a damaged diaphragm 6, etc., the container 7 prevents the electromagnet coils 4 from contacting such liquid or flammable gas, enabling the avoidance of the risk of short circuit or explosion so that a safe pump 1 can be provided.

Furthermore, by having contained the pair of electromagnet coils 4 in one container 7 and having formed the passage P for the oscillator 5 in the container 7, only mounting the container 7 to the casing 2 of the pump 1 completes the installation of the electromagnetic drive including the electromagnet coils 4. Therefore, it is easy to position the pair of electromagnet coils 4 with respect to each other and to position the electromagnet coils 4 and the oscillator 5 with respect to each other, and allowing easy installation, etc. thereof. Furthermore, since the electromagnet coils 4 can be protected from liquid or flammable gas by the one container 7, the number of parts can be reduced.

It is preferred that the material of the partition wall of the container 7 is made of synthetic resin or metal, but not limited especially, in order to transmit the magnetism from the electromagnet coils 4. In this case, it is preferred that the thickness of the partition wall is 1-2 mm, but not limited especially, for easy transmission of magnetism. Furthermore, it is preferred that the metal, if used as the material, is non-magnetic metal such as aluminum, copper, non-magnetic stainless and so on to prevent attracting of the permanent magnets 51, 52 of the oscillator 5 to the container 7 during the shutdown of the pump 1.

Figure 3:
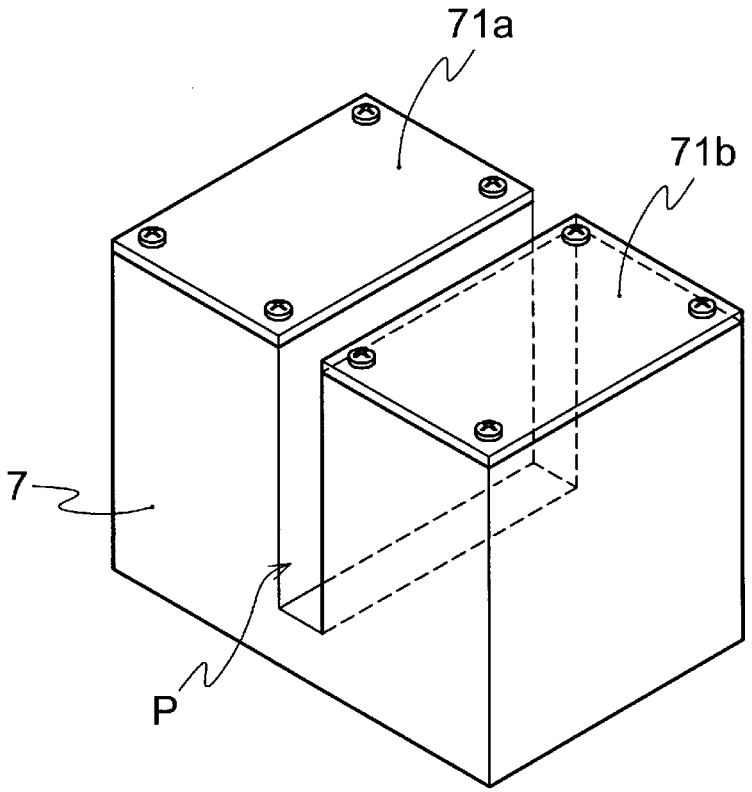
FIG. 3 A perspective view showing another embodiment of the electromagnet coil container used for the electromagnetic vibrating pump of the presently disclosed embodiment.

There is no specific limitation of the shape of the container 7 as long as it can contain the electromagnet coils 4 and the passage P for the oscillator 5 is formed therein. However, with respect to the shape of the container 7, the cross-section perpendicular to the moving direction of the oscillator 5 with the container 7 sealed can be, for example, substantially O-shaped as shown in FIG. 2, or substantially U-shaped as shown in FIG. 3. Also, it can have a reversed U-shape formed by putting the container 7 in FIG. 3 upside down, and while two covers 71*a*, 71*b* seal the openings of the container 7 in FIG. 3, the two openings in FIG. 3 can be closed with one cover instead of two.

In addition, while the passage P has a rectangular shaped cross-section in FIG. 2, it can be circular, oval as well as polygonal in accordance with the shape of the oscillator 5.

Additionally, while the contour of the container 7 is substantially rectangular parallelepiped as a whole in FIGS. 2 and 3, its contour is not especially limited as long as the container 7 can contain the electromagnet coils 4, and of course, it may be curved partly or provided with concavity and convexity.

Figure 4:
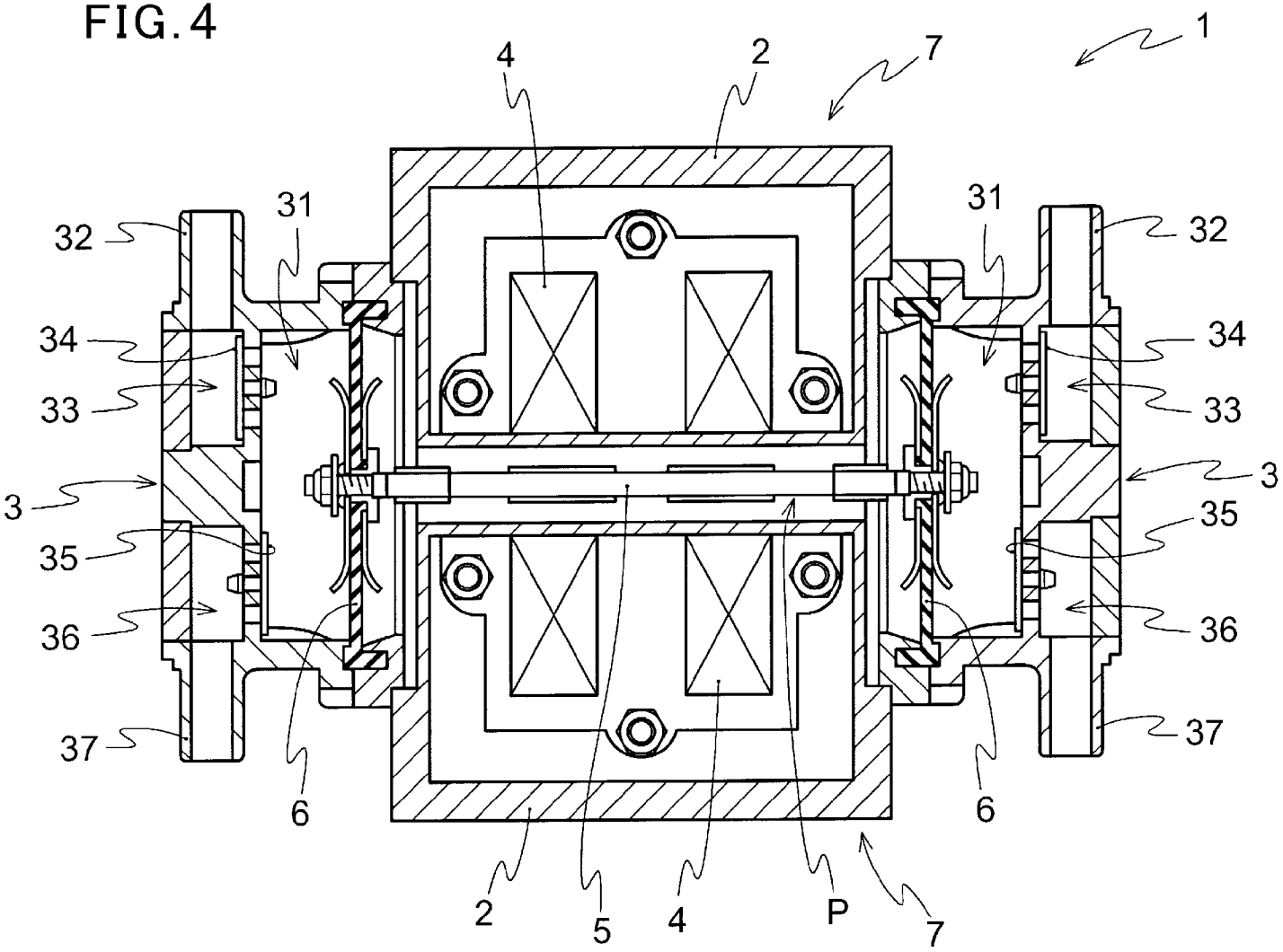
FIG. 4 A cross-sectional view showing another embodiment of the electromagnet coil container, as integrated with a casing, used for the electromagnetic vibrating pump of the presently disclosed embodiment.
Figure 5:
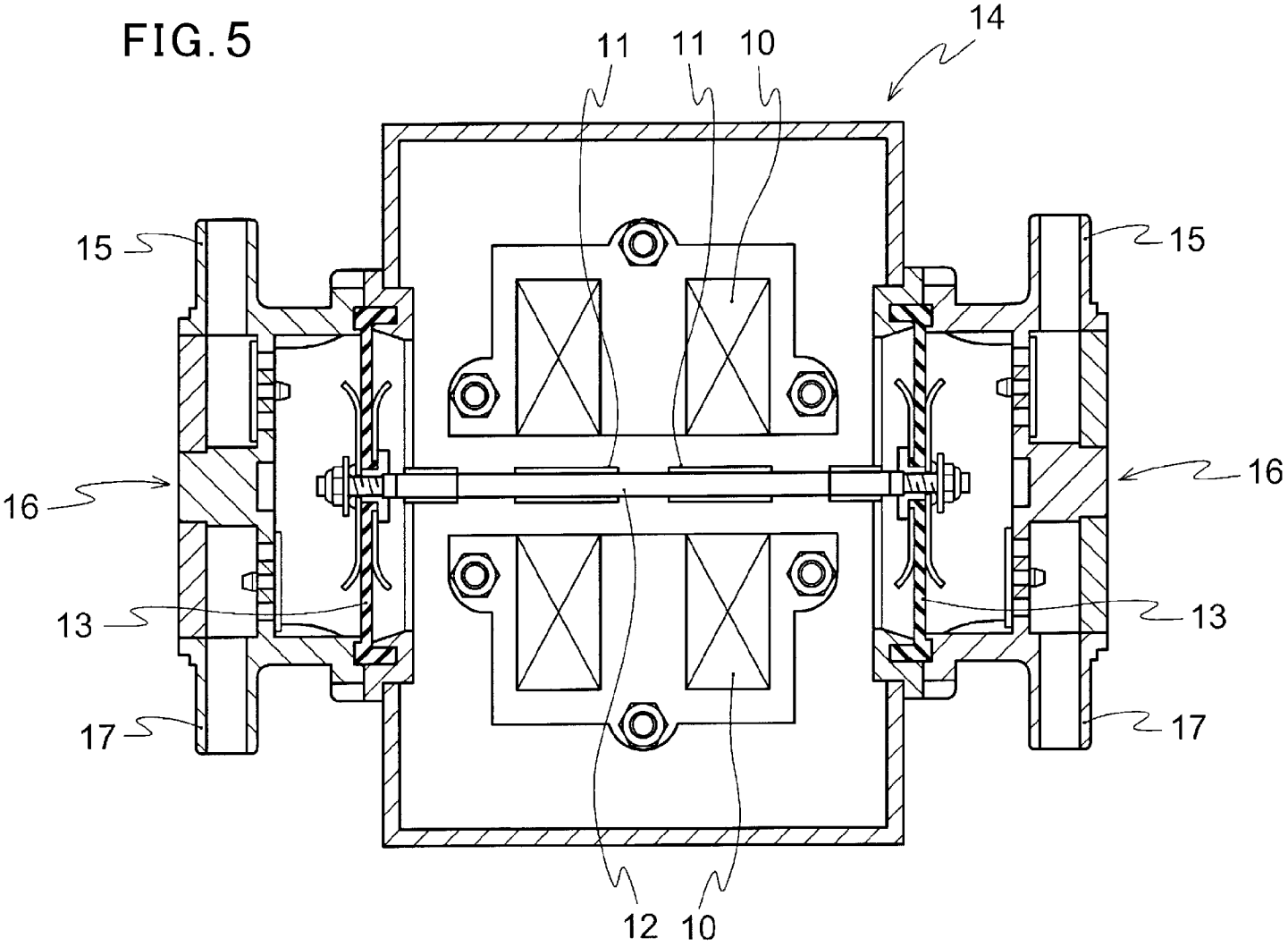
FIG. 5 A cross-sectional view for schematically explaining a conventional electromagnetic vibrating pump.

In addition, in the embodiments of FIGS. 1-3, the container 7 is described which is contained inside the casing 2, the body being separated from the container 7, and is fixed to the casing 2 by the fixing means such as a screw. However, since the presently disclosed embodiment aims to enable the prevention of the penetration of the fluid which has flown into the compression chamber 31 inside the container 7 in the case of damaged diaphragm and so on, the container 7 formed in integration with the casing 2 as shown in FIG. 4 is also covered by the presently disclosed embodiment. In the embodiment shown in FIG. 4, since the casing 2 and the container 7 are integrated with each other, the number of parts for the pump 1 can be further reduced, without requiring the fixing means to fix the container 7 to the casing 2. In addition, like the embodiments of FIGS. 1-3, the electromagnet coils 4 are arranged to contact the partition wall on the side of the passage P, and thus only mounting the casing 2 to the pump casing 3 and inserting the oscillator 5 into the passage P can complete the assembly of the pump 1.

EXPLANATION OF SYMBOLS

1 Pump
2 Casing
3 Pump casing
31 Compression chamber
32 Exhaust port
33 Exhaust chamber
34 Exhaust valve
35 Suction valve
36 Suction chamber
37 Suction port
4 Electromagnet coil
5 Oscillator
51, 52 Permanent magnet
6 Diaphragm
7 Container
71, 71*a*, 72*b* Cover
S Fixing means
P Passage

The invention claimed is:

1. An electromagnetic vibrating diaphragm pump comprising:

a casing containing a pair of opposing electromagnet coils to which an alternating-current power source is connected and an oscillator arranged movably in reciprocation between the pair of electromagnet coils; and a pair of pump casings fixed to both ends of the casing via diaphragms fixed to both ends of the oscillator, and adapted to suction fluid from outside and discharge fluid to outside by reciprocating motion of the oscillator and elastic deformation of the diaphragms, wherein an electromagnet coil container is further provided inside the casing, the electromagnet coil container containing the pair opposing electromagnet coils, separated apart from each other forming a gap between the pair of opposing electromagnet coils along a direction perpendicular to a reciprocal moving direction of the oscillator so that the oscillator is located inside the gap, the pair of opposing electromagnet coils being contained in an airtight manner by the electromagnet coil container inside the casing, wherein electromagnet coil container has a box shape with an opening so as to contain the pair of opposing electromagnet coils in a space inside the electromagnet coil container, the space inside the electromagnet coil container, containing the pair of opposing electromagnet coils, is sealed from each of the diaphragms by a cover on the opening, and the electromagnet coil container is configured to prevent fluid penetrated into a space outside the electromagnet coil container from penetrating into a space inside the electromagnet coil container, and wherein the electromagnet coil container has a passage formed in between the pair of opposing electromagnet coils separated from each other for the oscillator to move in reciprocation and the passage is formed of an outer surface of a partition wall of the electromagnet coil container, preventing fluid penetrated into a space inside the passage from penetrating into a space inside the electromagnet coil container.

2. The electromagnetic vibrating diaphragm pump of claim 1, wherein the partition wall of the container is made of material of magnetic permeability and non-magnetic body.

3. The electromagnetic vibrating diaphragm pump of claim 1, wherein the electromagnetic vibrating diaphragm pump is for liquid or flammable fluid.

4. The electromagnetic vibrating diaphragm pump of any one of claim 1, wherein the passage is formed along the moving direction of the oscillator, and the cross-sectional shape of the container perpendicular to the moving direction of the oscillator is substantially O-shaped or substantially U-shaped.

5. The electromagnetic vibrating diaphragm pump of any one of claim 1, wherein the container is formed in integration with the casing.

6. The electromagnetic vibrating diaphragm pump of claim 2, wherein the electromagnetic vibrating diaphragm pump is for liquid or flammable fluid.

7. The electromagnetic vibrating diaphragm pump of claim 2, wherein the passage is formed along the moving direction of the oscillator, and the cross-sectional shape of the container perpendicular to the moving direction of the oscillator is substantially O-shaped or substantially U-shaped.

8. The electromagnetic vibrating diaphragm pump of claim 3, wherein the passage is formed along the moving direction of the oscillator, and the cross-sectional shape of the container perpendicular to the moving direction of the oscillator is substantially O-shaped or substantially U-shaped.

9. The electromagnetic vibrating diaphragm pump of claim 6, wherein the passage is formed along the moving direction of the oscillator, and the cross-sectional shape of the container perpendicular to the moving direction of the oscillator is substantially O-shaped or substantially U-shaped.

10. The electromagnetic vibrating diaphragm pump of claim 2, wherein the container is formed in integration with the casing.

11. The electromagnetic vibrating diaphragm pump of claim 3, wherein the container is formed in integration with the casing.

12. The electromagnetic vibrating diaphragm pump of claim 4, wherein the container is formed in integration with the casing.

13. The electromagnetic vibrating diaphragm pump of claim 6, wherein the container is formed in integration with the casing.

14. The electromagnetic vibrating diaphragm pump of claim 7, wherein the container is formed in integration with the casing.

15. The electromagnetic vibrating diaphragm pump of claim 8, wherein the container is formed in integration with the casing.

16. The electromagnetic vibrating diaphragm pump of claim 9, wherein the container is formed in integration with the casing.

* * * * *